US007044269B2

(12) United States Patent
Azran

(10) Patent No.: US 7,044,269 B2
(45) Date of Patent: May 16, 2006

(54) SCAFFOLD

(75) Inventor: Shlomo Azran, Kiryat-Gat (IL)

(73) Assignee: Azran Construction Automation Ltd., Ramat Hasharon (IL)

( * ) Notice: Subject to any disclaimer, the term of this patent is extended or adjusted under 35 U.S.C. 154(b) by 102 days.

(21) Appl. No.: 10/479,151

(22) PCT Filed: May 31, 2001

(86) PCT No.: PCT/IL01/00505

§ 371 (c)(1),
(2), (4) Date: Nov. 26, 2003

(87) PCT Pub. No.: WO02/097217

PCT Pub. Date: Dec. 5, 2002

(65) Prior Publication Data

US 2004/0168854 A1 Sep. 2, 2004

(51) Int. Cl.
*E04G 1/00* (2006.01)

(52) U.S. Cl. ..... 182/141; 182/146; 182/129

(58) Field of Classification Search ..... 182/141, 182/146, 129; 118/256, 259, 207, 208, 410; 414/729

See application file for complete search history.

(56) References Cited

U.S. PATENT DOCUMENTS

| | | | | |
|---|---|---|---|---|
| 2,236,737 | A * | 4/1941 | Stone | 118/612 |
| 3,323,616 | A * | 6/1967 | Best | 182/146 |
| 4,993,913 | A * | 2/1991 | Ohtsuki | 414/729 |
| RE34,404 | E * | 10/1993 | Dupont et al. | 182/146 |
| 6,186,273 | B1 * | 2/2001 | Goldbach et al. | 182/128 |
| 2004/0020717 | A1 * | 2/2004 | Robillard | 182/141 |

FOREIGN PATENT DOCUMENTS

| | | |
|---|---|---|
| FR | 2 671 336 A | 7/1992 |
| GB | 2 311 800 A | 10/1997 |

* cited by examiner

*Primary Examiner*—Alvin Chin-Shue
(74) *Attorney, Agent, or Firm*—Alston & Bird LLP

(57) ABSTRACT

Scaffold erected adjacent to a wall, which enables an easy plastering, drying cleaning, coloring, etc. operation of the wall by automatic means. Said scaffold comprises: a. a platform being erected adjacent and parallel to the wall; b. column members carrying the platform and being connected to the wall, said columns being provided with electrically actuating means enabling the ascending and descending of the platform: c. a movable apparatus (or "cat") being attached to the platform, preferably located thereunder, which cat is able to move along the length of the platform and is provided with automatic means for actuating the plastering operation and realizing obstacles: d. automatic means for actuating the movable parts of the scaffold; and e. a storage container being suitably connected to the means performing the plastering operation.

12 Claims, 18 Drawing Sheets

SCAFFOLD

FIELD AND BACKGROUND OF THE INVENTION

The present invention relates to a scaffold erected adjacent to a wall (hereinafter called "scaffold"), which scaffold enables an easy plastering, drying cleaning, coloring, etc. operation (hereinafter called "plastering") of the wall by automatic means. It also enables an easy performance of repair and the like operations as well as manual performances, if required.

There are known many scaffolds for this purpose erected adjacent to a wall, e.g. that described and claimed in Israel patent specification No 113,990. However, these known structures are quite complicated in their use, in particular as that use requires much manpower in the course of the plastering operation. Moreover, in none of said known scaffolds the plastering operation can be performed automatically without manual work, e.g. with electrical means and by remote control.

It has thus been desirable to design a scaffold to be erected adjacent to a wall which enables a simple automatic performance of the plastering, inter alia, with rather non complicated electrical means, e.g. by way of remote control. The costs involved in the production of said scaffold should be reasonable and its production and erection should not be complicated.

SUMMARY OF THE INVENTION

The present invention thus provides a scaffold (as herein defined) comprising:

a. a platform adapted to be erected adjacent and parallel to a wall;

b. columns carrying the platform and adapted to be connected to the wall, said columns being provided with electrically actuating means enabling the ascending and descending of the platform;

c. a movable apparatus (herein called "cat") attached to the platform, preferably located thereunder, which cat is able to move along the length of the platform and is provided with automatic means for performing a plastering operation and realizing obstacles;

d. automatic electrical pneumatic and/or electrical hydraulic means for actuating the various movable parts of the scaffold; and e. a storage container suitably connected to the means performing the plastering operation.

The actuating electrical means are advantageously actuated by remote control means.

The platform advantageously comprises the following parts:

a. a floor located on a base;

b. two railings extending vertically along the two sides of the floor;

c. at least one toothed bar extending along the side of the floor and being provided with means carrying the movable apparatus or "cat" and causing the movement thereof;

d. supports for guiding electrical motors; and e. openings for the columns.

In an advantageous embodiment there extend two toothed bars along both sides of the floor.

On the platform is preferably located a compressor on which is mounted a board to which are connected a radio receiver and a control panel. Said compressor actuates the movement of the cat.

There has to be present one central column and at least one side column.

Each column comprises an outside sheet. Said sheet is connected at both sides to a further sheet via a comb-like wall in such a manner that the sheets form a cavity between them.

The further sheet is advantageously provided with several openings.

In said columns is located at least one system (advantageously more), which prevents the descent of the entire platform. Said system may be, e.g. cables inserted in the comb like wall.

Outside of the columns extend preferably suitable cables being connected to rotating drums on which they are rolled. The drums and thus the cables are actuated by electrical means, e.g. motors and gears at least at the central column, which may be actuated by remote control means, which motors cause the ascending and descending of the platform.

The manner in which the cables are located on the drums determines the required height of the platform. The central column is advantageously connected to two drums each being actuated by a motor and a gear, both motors and gears suitably operating in a synchronized manner.

The cat enables the plastering means to move automatically along the length of the platform. Thus, the plastering can be performed in a convenient manner along the entire length of the wall in the desired height and at the desired location.

The cat is preferably provided with an electrical eye, sensors and/or a camera. Said means indicate places where the cat cannot move as a result of an obstacle caused by a rod, a window, a place which is not properly plastered or the like. The eye actuates means, e.g. openings of rails extending on the platform so that the cat may then continue to move on.

The storage container comprises the suitable plastering, drying, cleaning, coloring, etc. material required for the operation to be performed. Care should be taken that a always enough material is present in the container. The plastering material is forwarded advantageously from the container to the plastering means by an electrically actuated pump, cables etc.

The scaffold according to the present invention may be actuated entirely in an automatic manner. The plastering operation thus does not require any manpower on the platform. The height of the platform, the location of the plastering arrangement and the movement thereof can be controlled by way of a remote control apparatus. The performance of the plastering operation can also be actuated by the same remote control apparatus.

The electrical actuation of the various electrical elements may be performed in any conventional manner by suitable electrical elements, e.g. a motor, a gear etc.

BRIEF DESCRIPTION OF THE DRAWINGS

The present invention will now be illustrated with reference to the accompanying drawings without being limited by them. (Identical parts appearing in several Figs will be referenced for the sake of clarity by the same numerals.)

In said drawings.

DETAILED DESCRIPTION OF THE INVENTION

Figure 1:
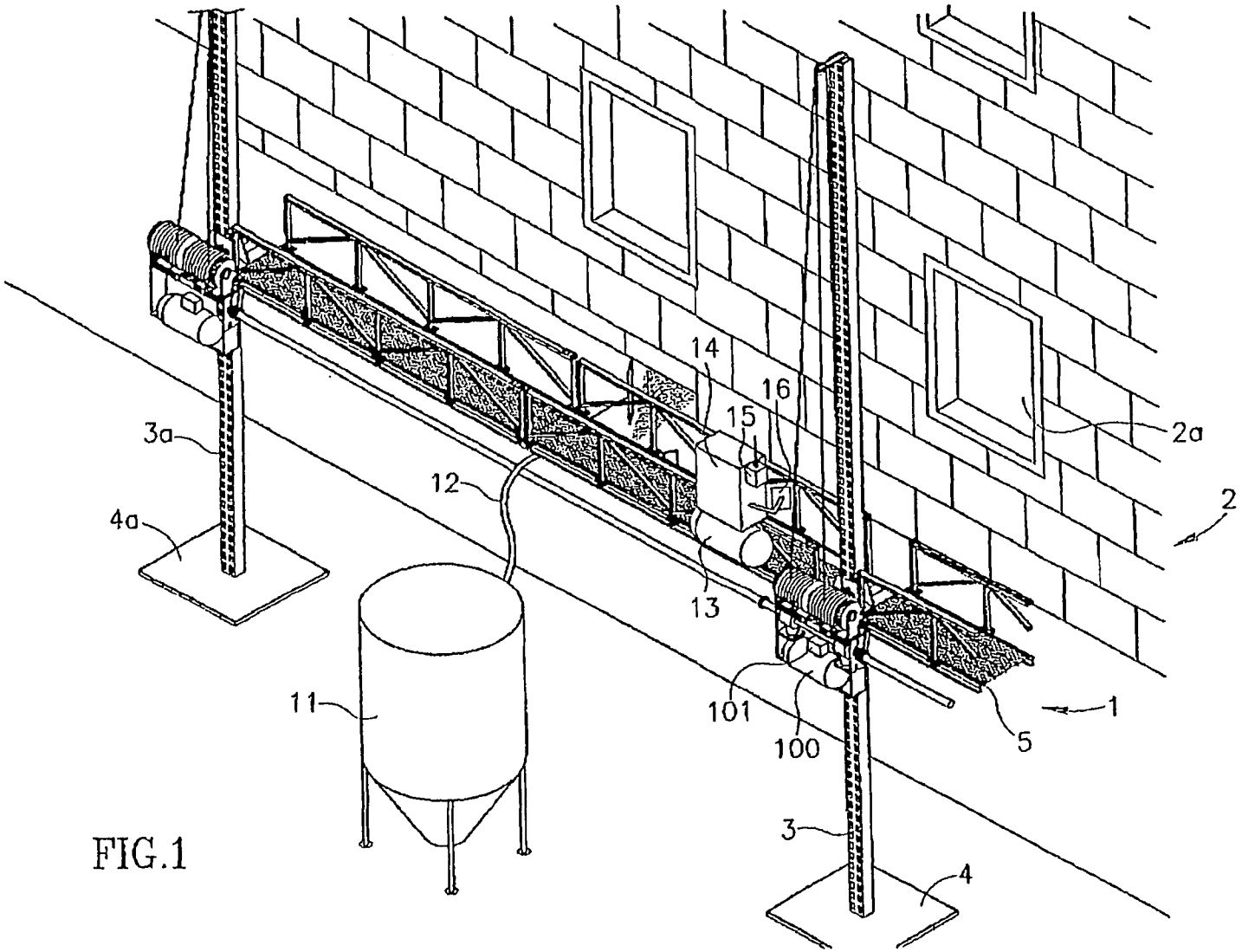
FIG. 1 shows a general perspective view of a scaffold according to the present invention being connected to a wall.

Scaffold 1 shown in FIG. 1 is connected to wall 2 which is provided with window 2*a*. Wall 2 is connected by means (not shown) to central column 3 and to side column 3*a* standing on bases 4 and 4*a*, respectively. The columns will be described in detail in FIGS. 4 to 6.

Storage container 11 is connected by cable 12 to the plastering means (not shown).

Upon platform 5 is located compressor 13 actuating all hydraulic parts. On compressor 13 is arranged a main board 14 which is connected to radio receiver 15 and control panel 16. Radio receiver 15 and control panel 16 actuate compressor 13 via main board 14. Also shown are air tank 100 and control 101. Air tank 100 is an air reservoir which aids compressor 13 to actuate the various hydraulic parts.

Figure 2:
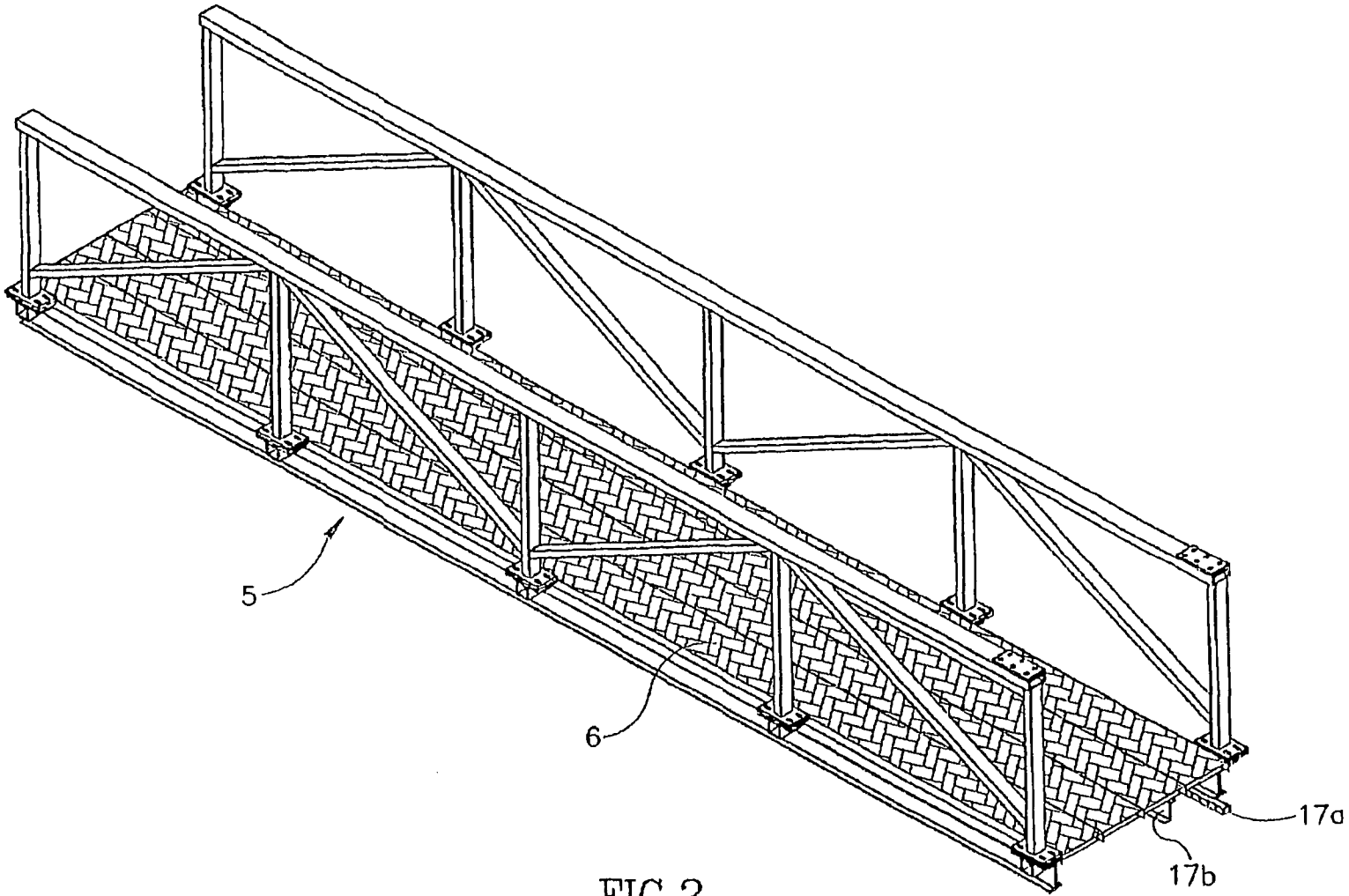
FIG. 2 shows an enlarged view of a platform.
Figure 3D:
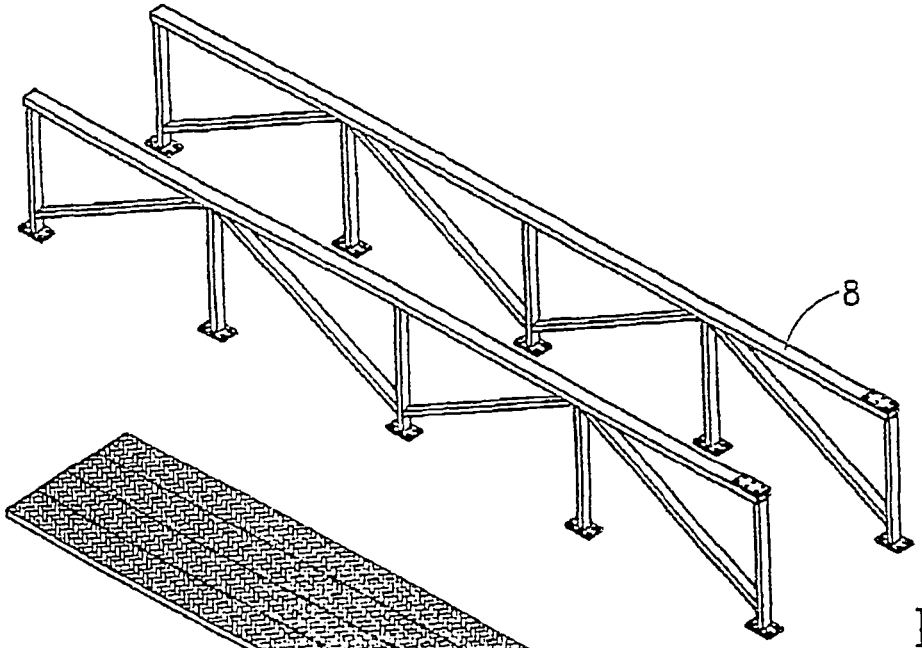
FIGS. 3*a–d* show the parts of the platform.
Figure 3C:
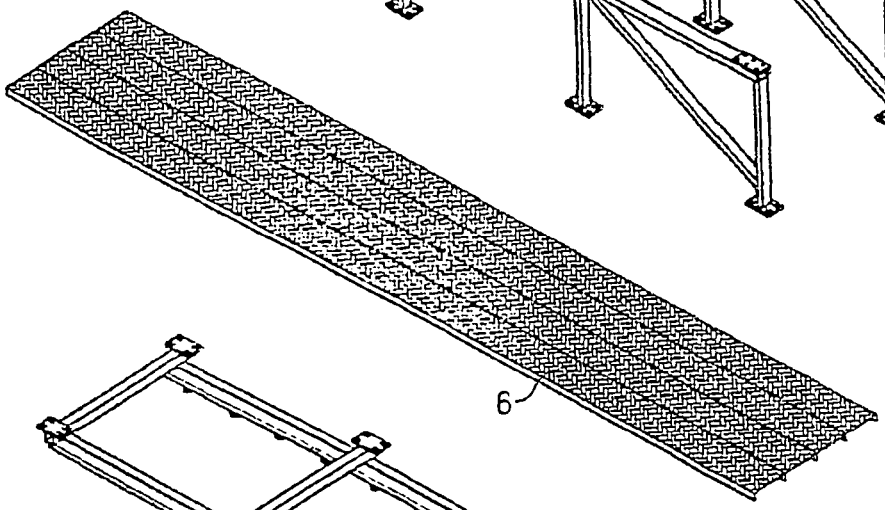
Figure 3B:
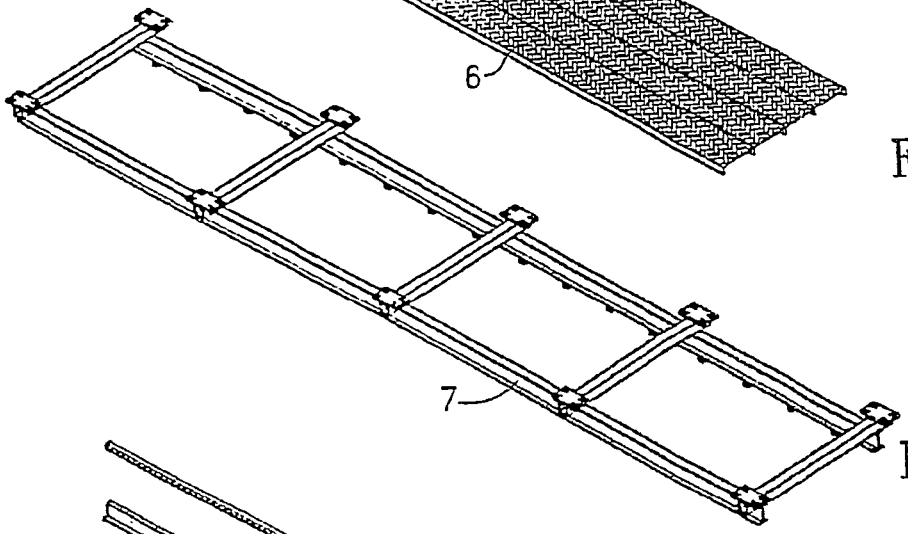
Figure 3A:
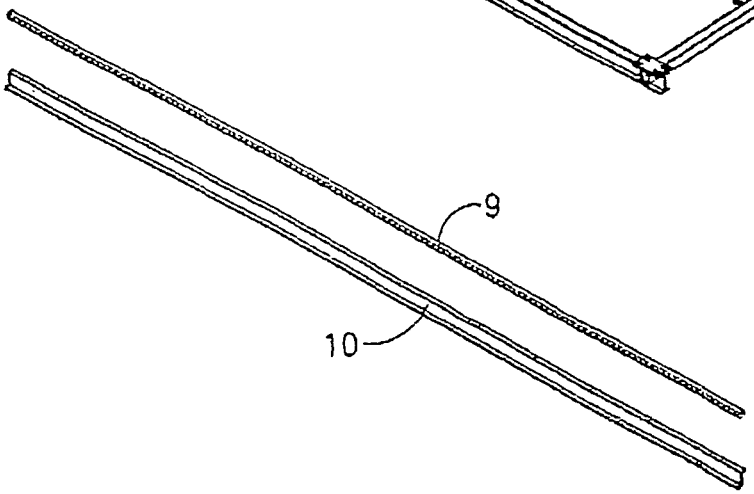

Platform 5 of scaffold 1 shown in FIGS. 2 and 3 comprises floor 6 which is located on a support base 7 (shown only in FIG. 3*b*), railings 8, bar 9 with a row of teeth (often referred to as a "rack") (shown only in FIG. 3*a*) and support line for carrying the cat (not shown). Guiding support 10 extends parallel to floor 6 of platform 5.

Platform 5 is provided with openings (not shown) through which columns 3 and 3*a* can pass.

Platform 5 is shown in detail in FIGS. 2 and 3 *a–d*. The platform shown in FIG. 2 shows also wheels 17*a* and 17*b*. Said wheels 17*a* and 17*b* carry the cat (not shown).

Figure 4:
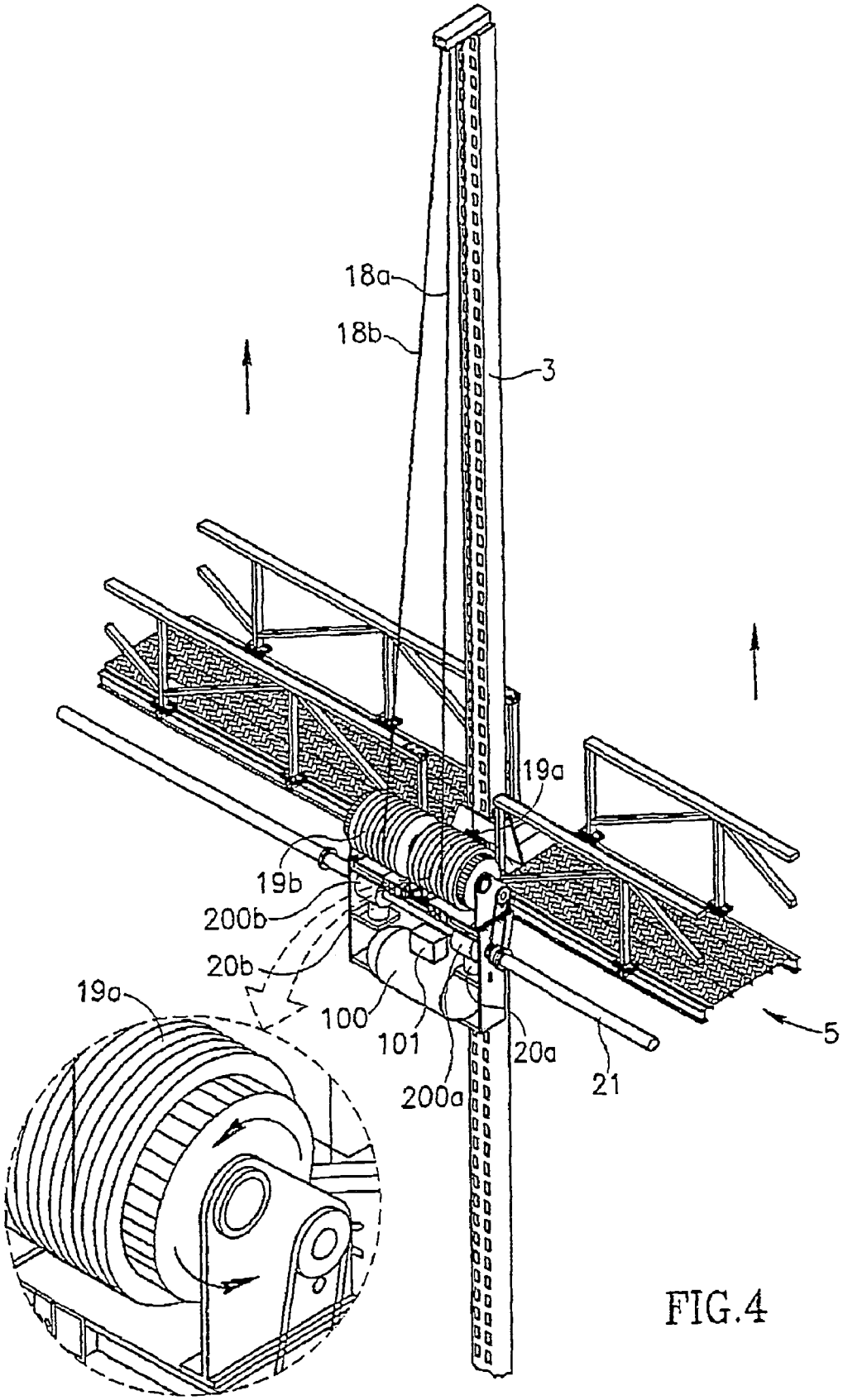
FIG. 4 shows a enlarged general perspective view of a platform through which passes a central column.

In FIG. 4 is shown column 3 passing through an opening (not shown) of platform 5.

Figure 5:
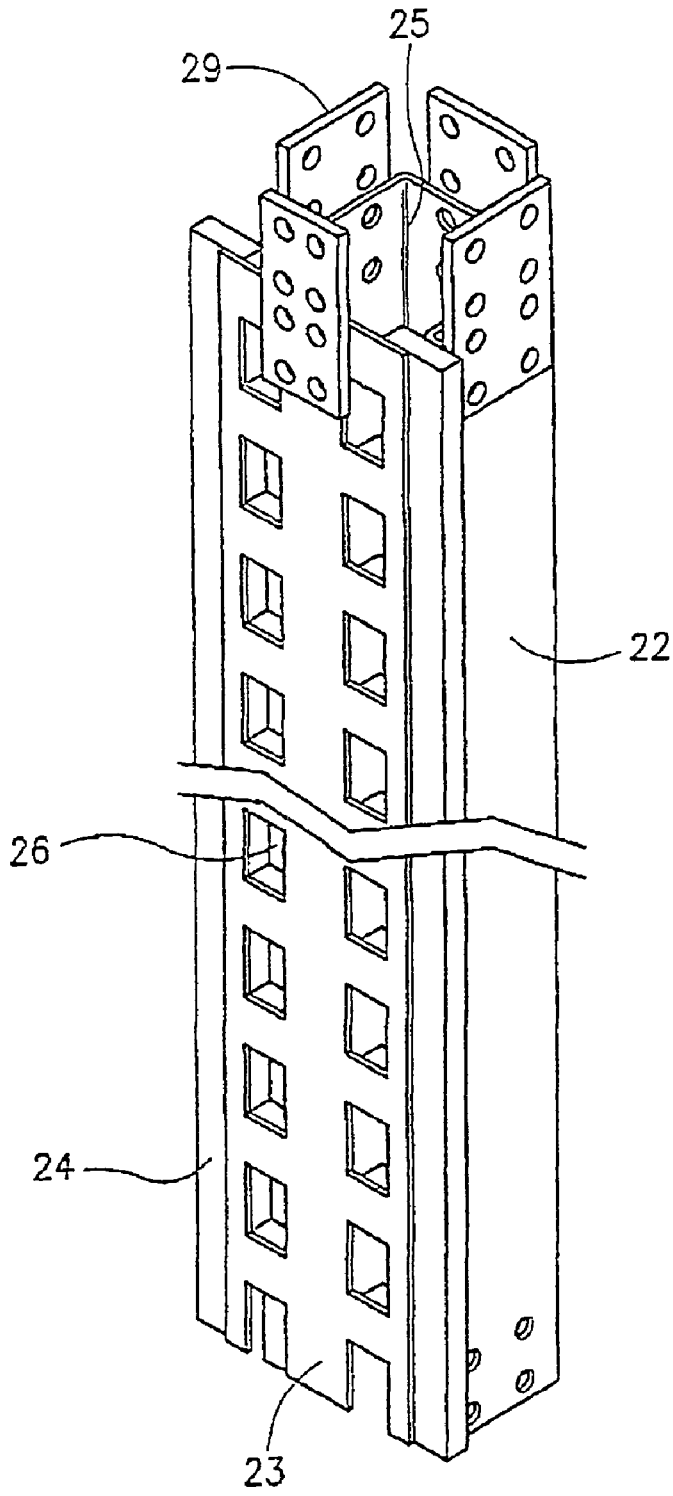
FIG. 5 shows an enlarged view of column.
Figure 6A:
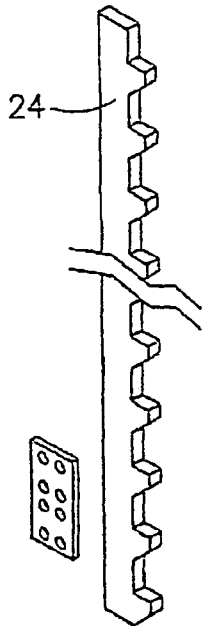
FIGS. 6*a–d* show the parts of the column.
Figure 6B:
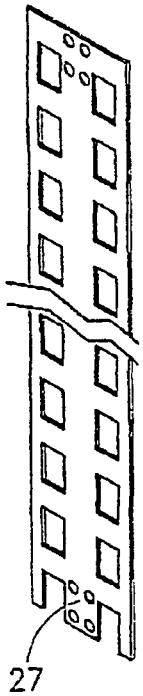
Figure 6C:
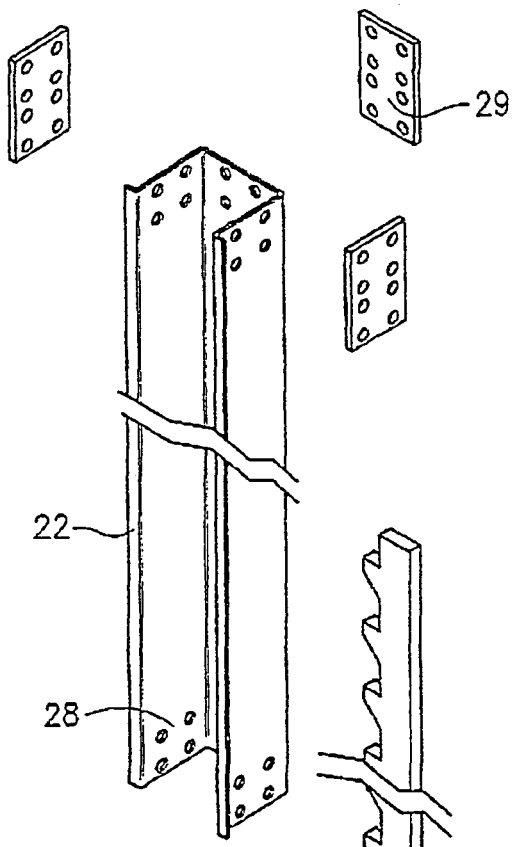
Figure 6D:
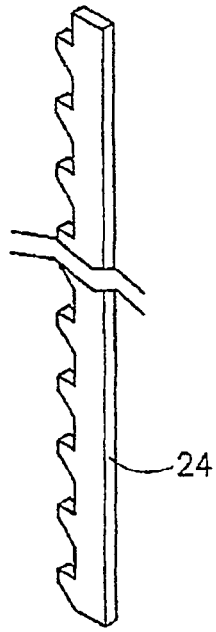

Column 3 is described in detail in FIGS. 5 and 6. Outside column 3 extend cables 18*a* and 18*b* being rolled on drums 19*a* and 19*b* respectively. Drums 19*a* and 19*b* are actuated by motors 20*a* and 20*b* located via gears 200*a* and 200*b* respectively on dry shaft 21 which dry shaft 21 actuates further drums (not shown). (An enlarged embodiment of drum 19*a* and the movement thereof is shown at the bottom of FIG. 4.)

The column shown in FIGS. 5 and 6 comprises outside sheet 22. Sheet 22 is connected at both sides to sheet 23 via comb-like wall 24 in such a manner that said sheets form cavity 25 between them.

The various parts of the column are shown in detail in FIGS. 6*a–e*.

Wall 23 is provided with openings 26 and at the bottom and at the top thereof with holes 27. Holes 28 are located at the bottom and the top of outside sheet 22. Further are shown parts 29.

Figure 7:
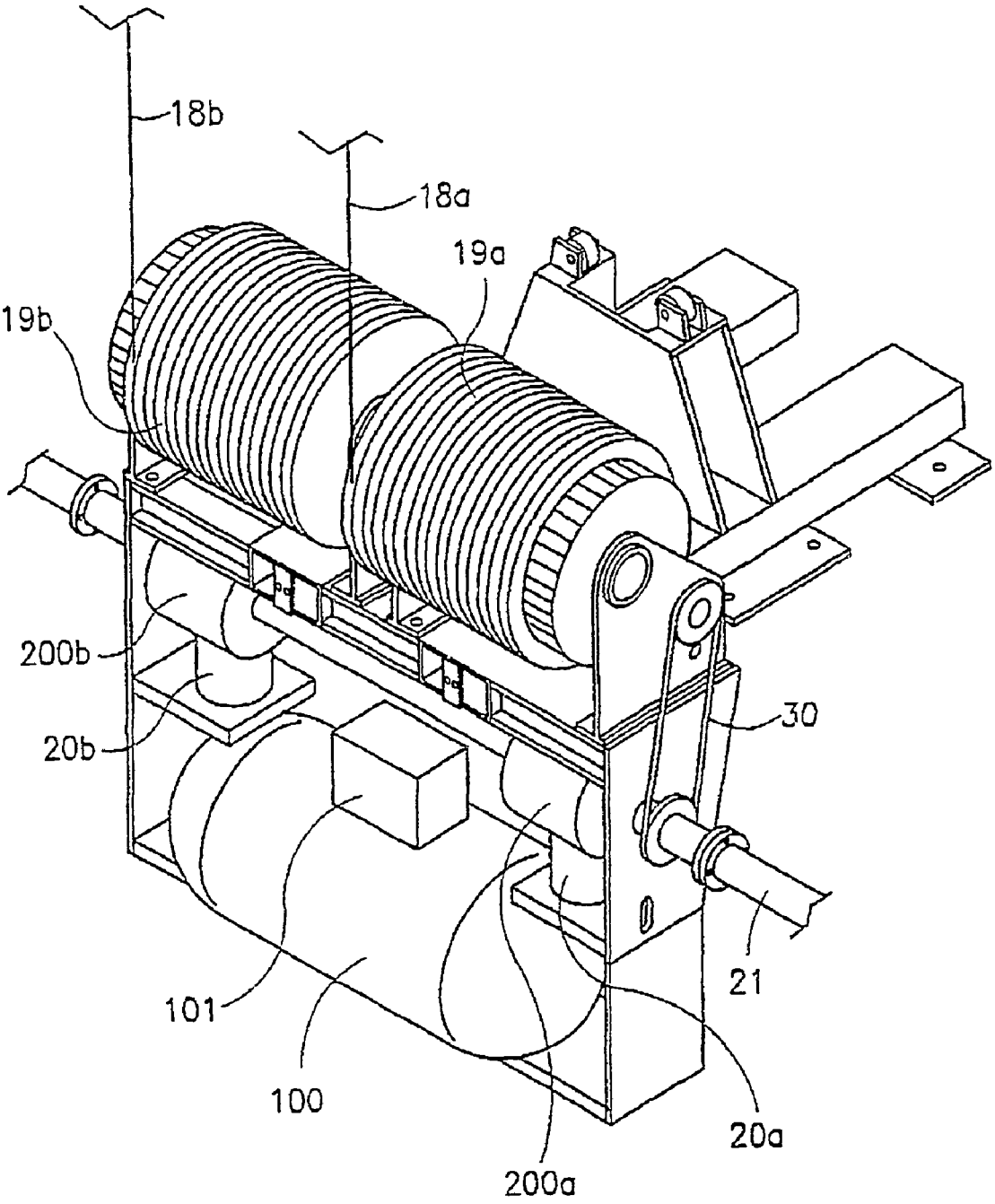
FIG. 7 shows an enlarged view of the system causing the ascent and descent of the platform.
Figure 8:
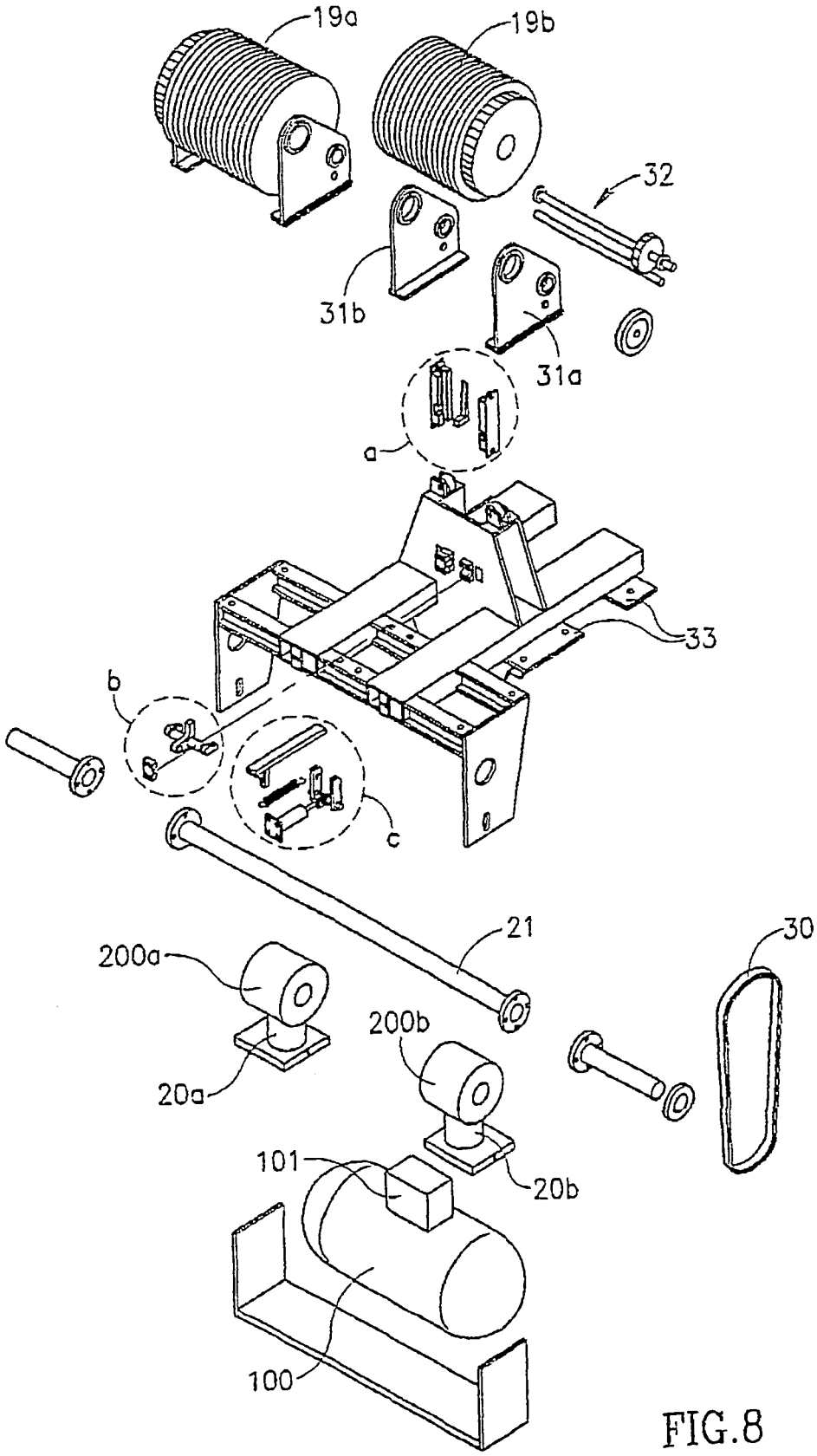
FIG. 8 shows parts of the system shown in FIG. 7 causing ascending and descending of the platform.

FIGS. 7 and 8 show the operating system in which are shown drums 19*a* and 19*b* on which are rolled cables 18*a* and 18*b*, respectively. Said drums 19*a* and 19*b* are caused to rotate by motors 20*a* and 20*b*, gears 200*a* and 200*b* and by drive belts 30. Motors 20*a* and 20*b* are located via gears 200*a* and 200*b* respectively on shaft 21.

FIG. 8 shows in detail the separate parts of the system shown in FIG. 7. Said parts are drums 19*a* and 19*b* on which are rolled cables 18*a* and 18*b*, respectively (not shown). Outside of the drums are located walls 31*a* and 31*b* through which pass rods 32 actuating drums 19*a* and 19*b*.

Motors 20*a* and 20*b*, gears 200*a* and 200*b*, drive belt 30 and shaft 21 are shown separately.

Moreover, there is shown support 33 for platform 5 (not shown).

Systems a, b and c which prevent the undesired descent of platform 5 are shown in detail in FIGS. 9, 10 and 11.

Figure 9A:
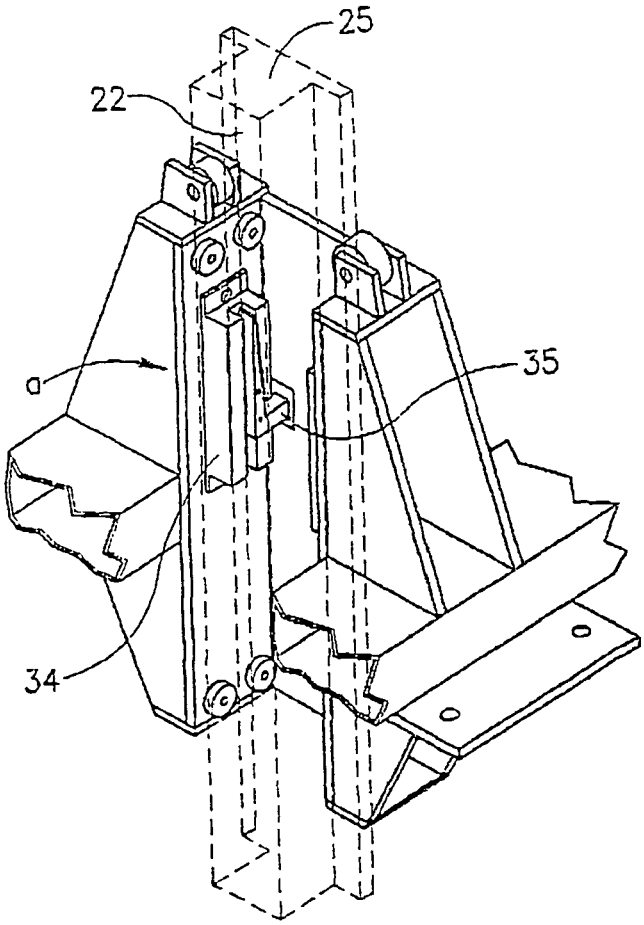
FIGS. 9*a* and 9*b* show system a preventing descent of the platform.

In FIG. 9*a* there is shown attached to both side walls 22 of column 3 system a which prevents said undesired descent of platform 5.

Figure 9B:
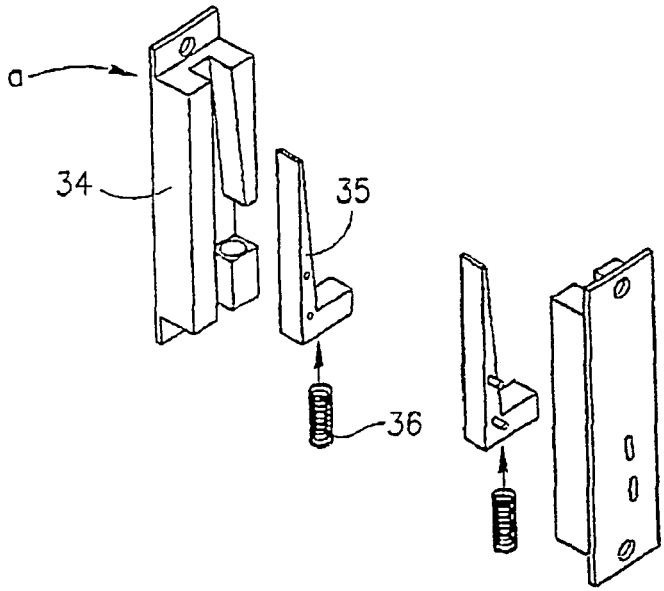

In FIG. 9*b* there is shown in more detail system a attached to wall 22. Said system a comprises housing 34 in which triangle 35 is located on springable means 36, which springable means 36 prevent by friction the descent of platform 5 when cable 18 (not shown) is torn.

Figure 10B:
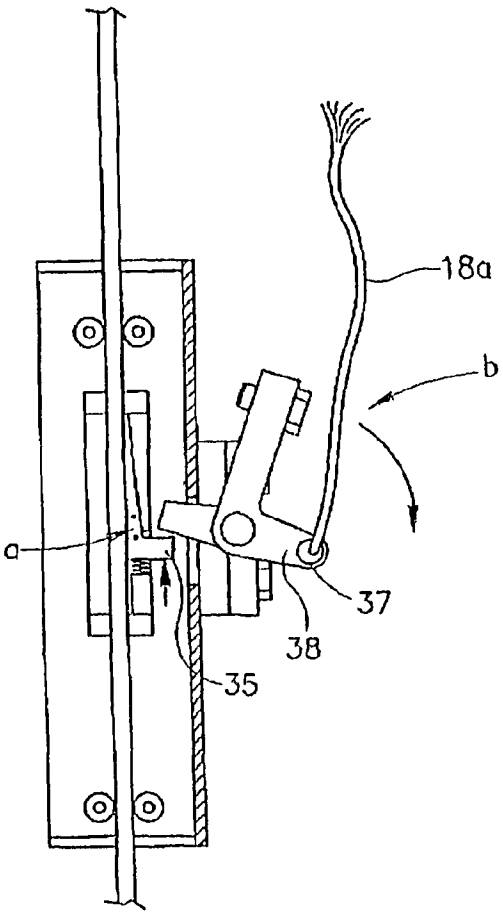
FIGS. 10*a* and 10*b* show system b preventing descent of the platform.
Figure 10A:
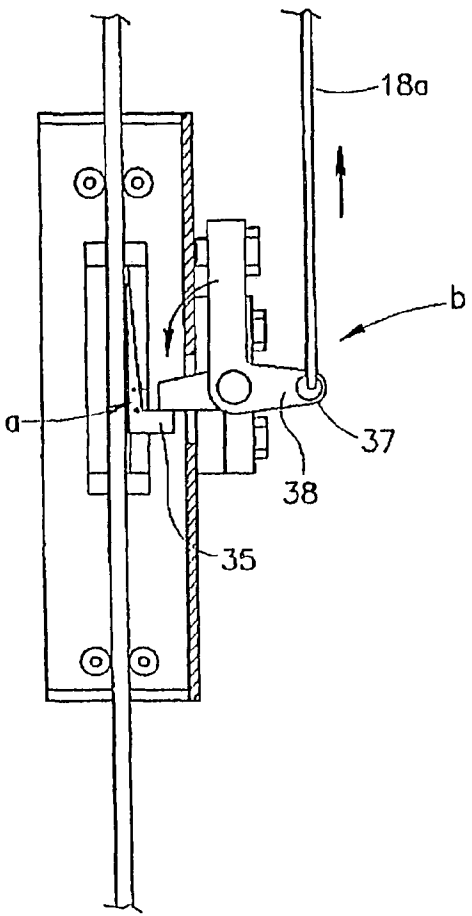

FIGS. 10*a* and 10*b* show system b preventing the descent of platform 5 which co-operate with system a shown in FIGS. 9*a* and 9*b*.

Said system b comprises the following parts and operates as follows;

In FIG. 10*a* cable 18*a* in the ascending position is caught in hole 37 of part 38. Part 38 is located on the base of triangle 35. When cable 18*a* is tom as shown in FIG. 10*b*, system a ascends upwards and stops the descending movement.

Figure 11A:
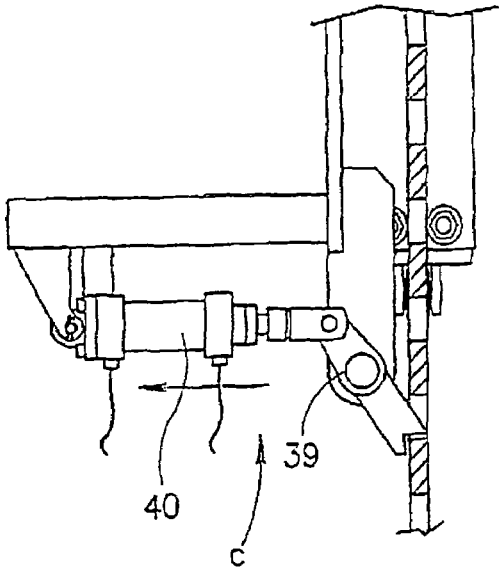
FIGS. 11*a*, 11*b* and 11*c* show system c preventing the descent of the platform.
Figure 11B:
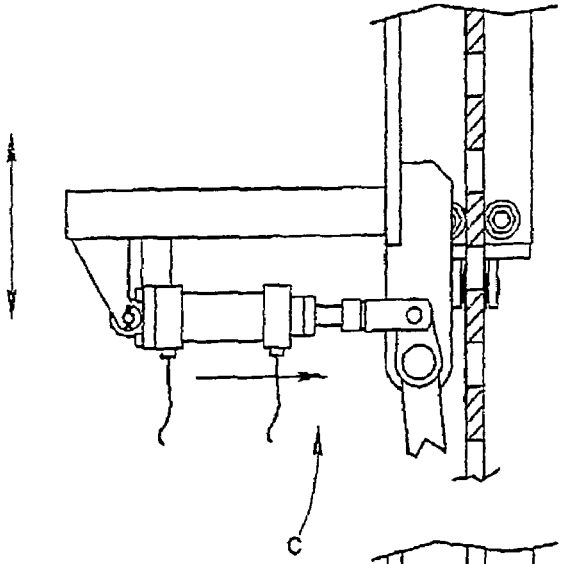
Figure 11C:
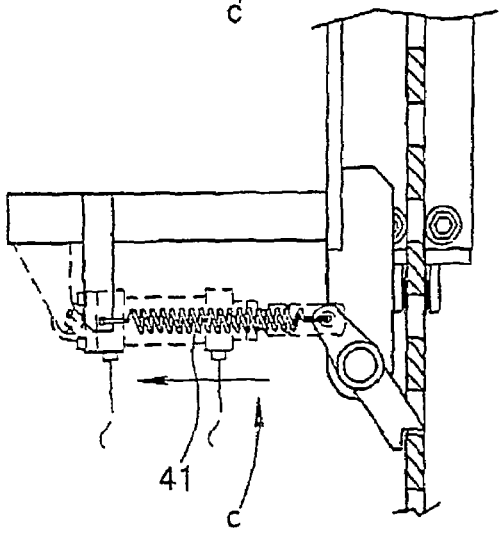

System c preventing the descent of platform 5 shown in FIGS. 11*a–c* comprises the following parts:

Arm 39 is connected at one end to piston 40 and at the other end to the openings of comb 24. As is shown in FIG. 11*c* piston 40 extends parallel to springable means 41.

FIG. 11*a* shows a regular ascending position.

FIG. 11*b* shows the open descending position. Whenever something happens, as shown in FIG. 11*c*, spring means 41 pushes arm 39 into the openings of comb 24.

Figure 12:
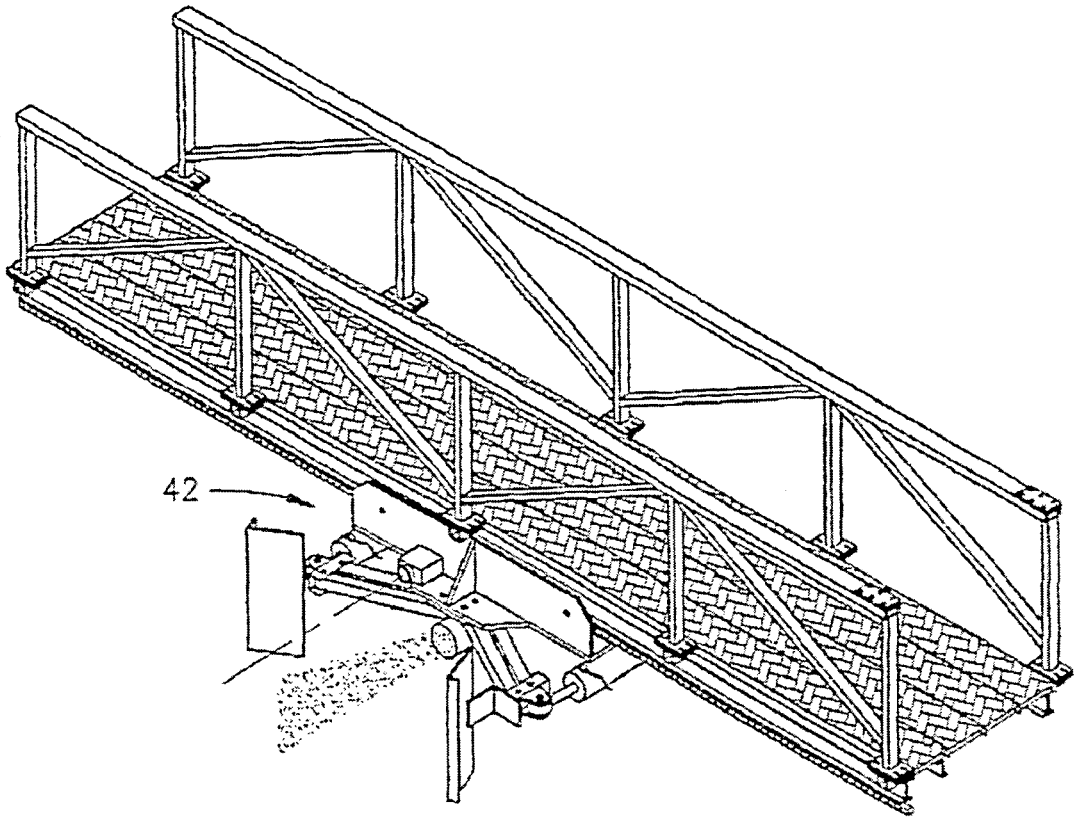
FIG. 12 shows a platform provided with a cat.

Platform 5 shown in FIG. 12 is the same platform 5 shown in FIG. 2 (drawn in the opposite direction) comprising cat 42, being located below floor 6.

Figure 13:
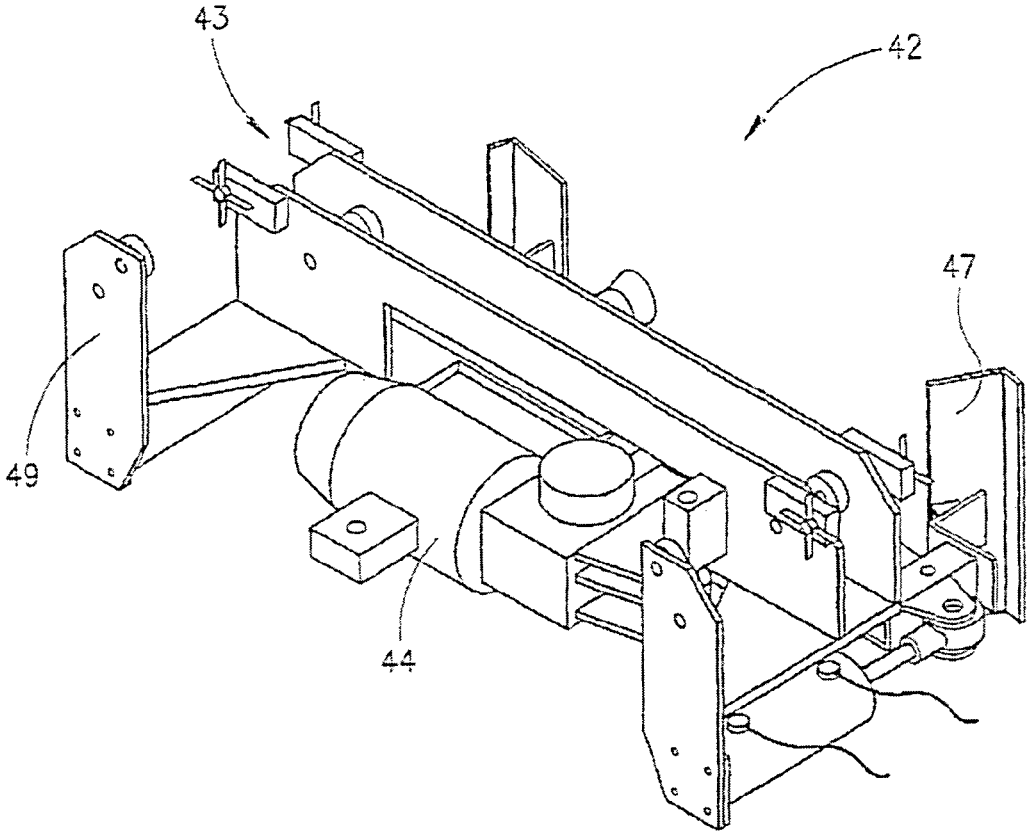
FIG. 13 shows an enlarged perspective view of a cat.
Figure 14:
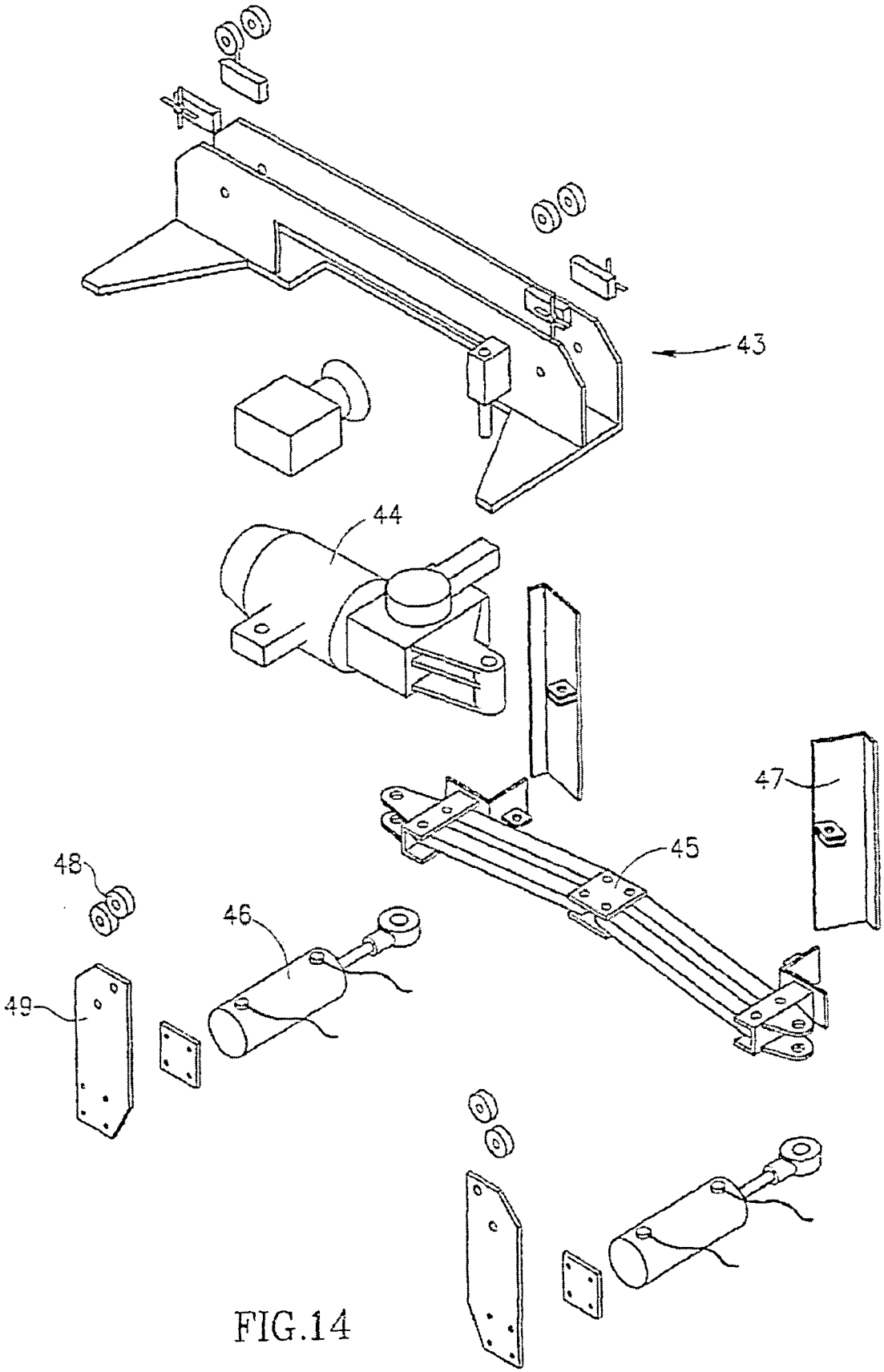
FIG. 14 shows parts of the cat shown in FIG. 13.

An enlarged perspective view of cat 42 is shown in FIGS. 13 and 14. An undisturbed movement of cat 42 along platform 5 is shown in FIGS. 15*a* and 15*b* and the movement of cat 42 on platform 5 which has obstacles is shown in FIGS. 16*a* and 16*b*.

Cat 42 shown in FIGS. 13–15 comprises base 43 to which is connected device 44 causing cat 42 to move horizontally. Unit 45 is connected to base 43.

As is shown unit 45 is connected at both ends to cylinder 46 actuating plastering means 47. There are also shown various sheets 48 and connecting parts 49.

Figure 15A:
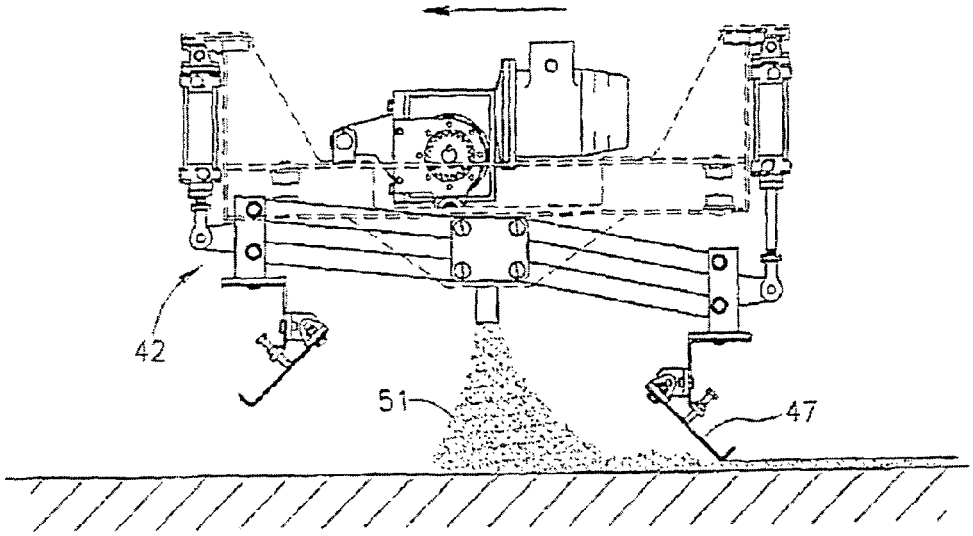
FIGS. 15*a* and 15*b* show the movement of the cat shown in FIGS. 13 and 14.
Figure 15B:
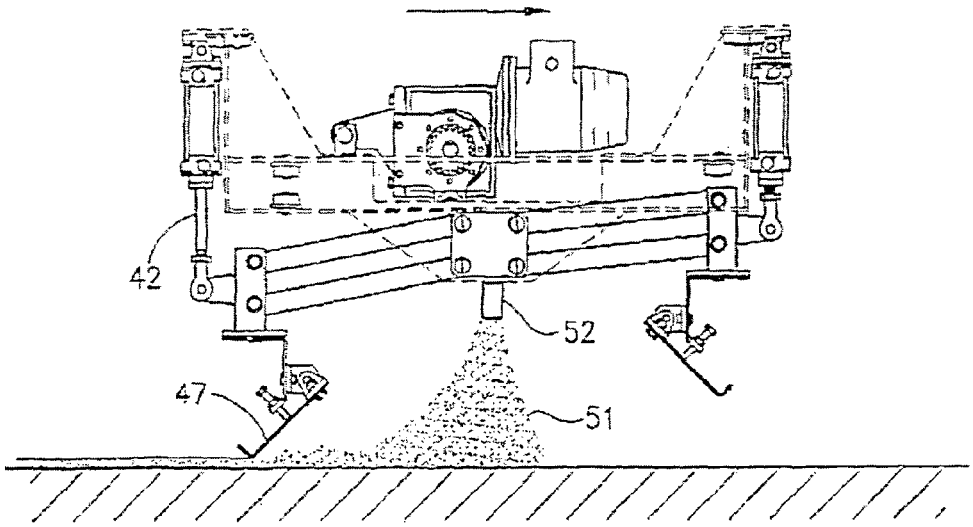
Figure 16A:
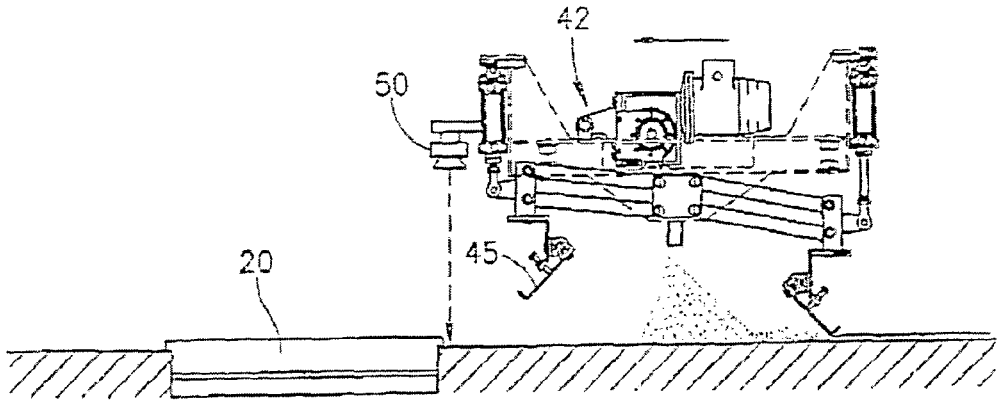
FIGS. 16*a* and 16*b* show the movement of the cat shown in FIGS. 13 and 14 on a platform which has obstacles for said movement.
Figure 16B:
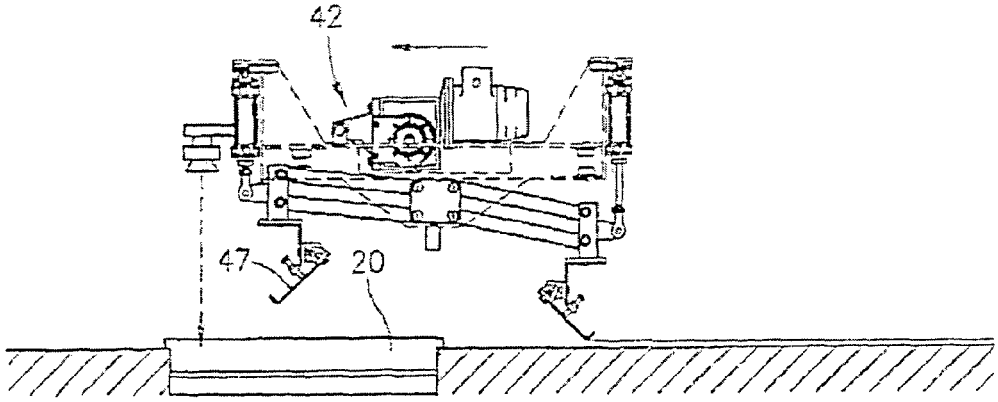

An undisturbed movement of cat 42 is shown in detail in FIGS. 15*a* and 15*b*. In FIG. 15*a* the movement is from right to left whereas in FIG. 15*b* the movement is in the opposite direction.

Cat 42 shown in FIGS. 16*a* and 16*b* comprises optical eye 50 connected to cat 42. Said eye 50 regulates the plastering operation and stops it when necessary, e.g. at window 20.

FIGS. 15 and 16 show plastering material 51 which passes through opening 52.

Figure 17A:
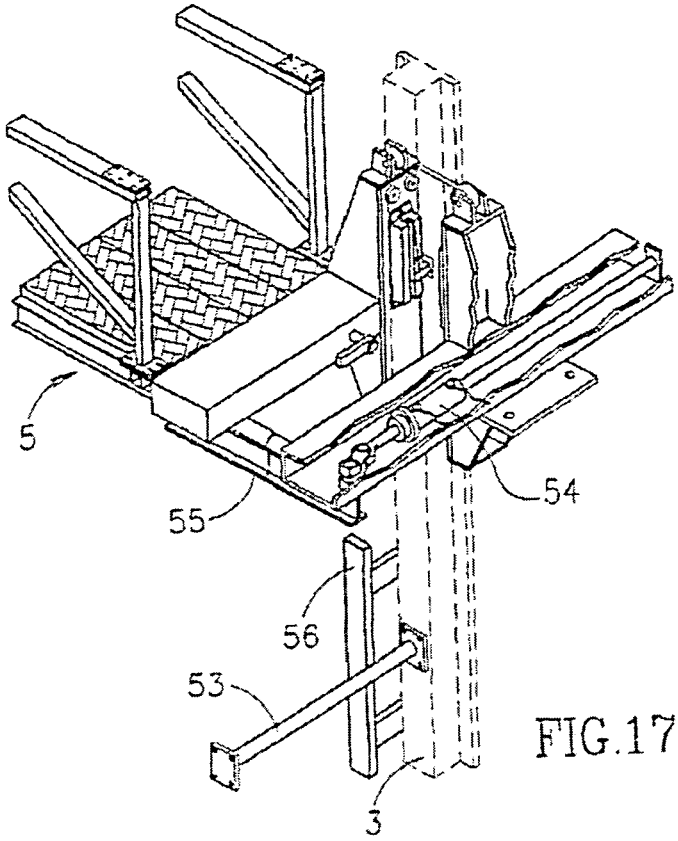
FIG. 17*a* and 17*b* show the movement of the platform where a rod is connecting the column to the wall.
Figure 17B:
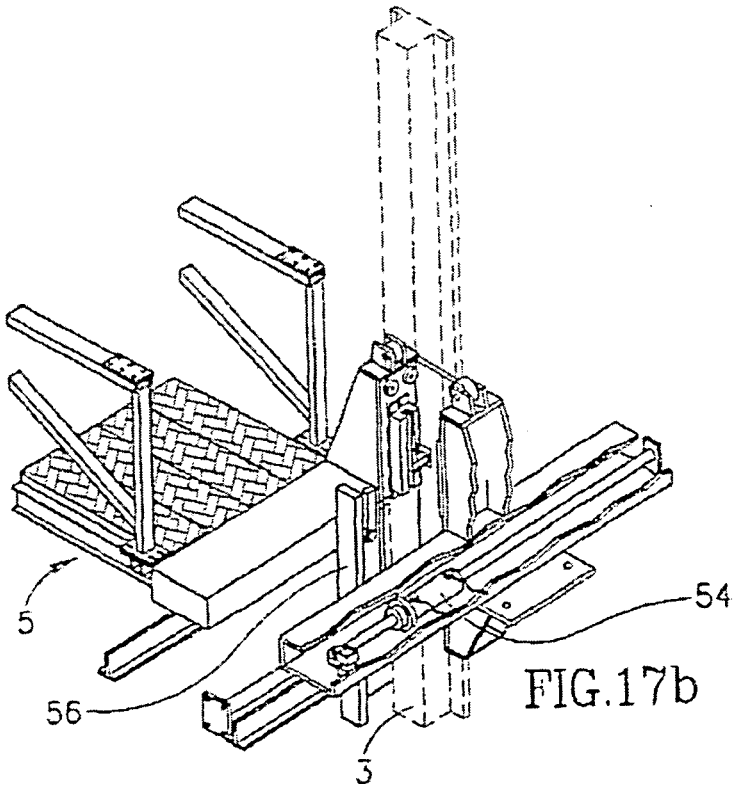

In FIGS. 17*a* and 17*b* is shown platform 5 through which passes column 3. Column 3 is provided with rods 53 (only one shown) being connected to wall 2. Internal piston 54 causes the opening of rail like 55 and thus allows the descending and ascending of platform 5 in spite of rod 53. Also is shown structure 56 which is connected to column 3.

Figure 18:
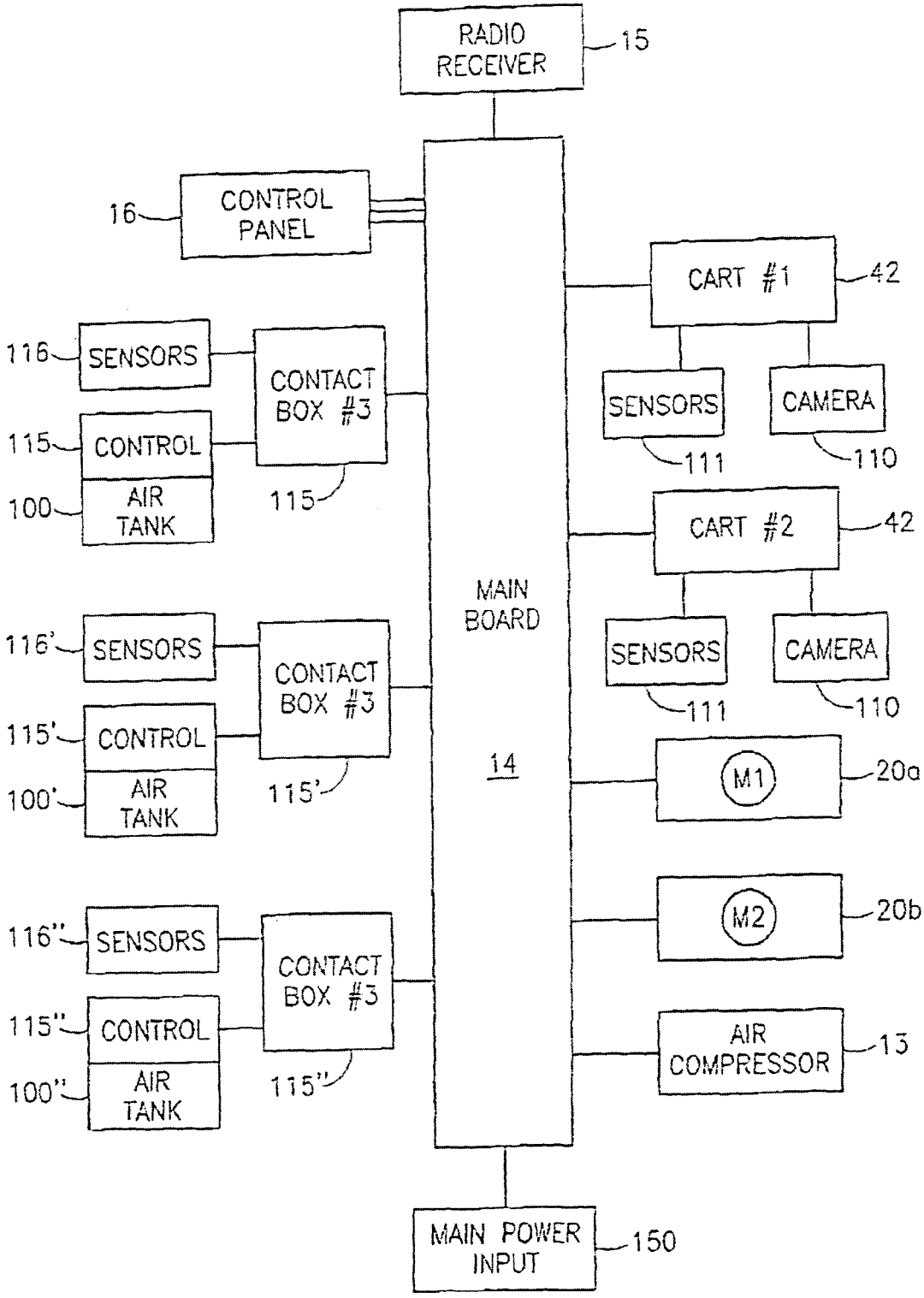
FIG. 18 shows a block diagram of a flow sheet whenever three columns and two cats are present.

The electric block diagram comprising the parts actuating the mechanical parts illustrated in FIGS. 1 to 17 is shown in FIG. 18.

Radio receiver 15 receives the instructions from the remote control (not shown) and is in turn connected to main board 14.

Main board 14 receives electricity from main power input 150.

Instructions are being sent from the remote control via receiver 15 and main board 14 to cats 42 and 42'. Said cats 42 and 42' are connected to cameras 110 and 110'. Said cameras 110 and 110' together with sensors 111 and 111' controls wall 2 in order to reveal obstacles, to control the quality and the distribution of the plaster, the color, the coating, etc.

Main board 14 actuates also motors 20*a* and 20*b*, which cause the ascending and descending of platform 5 on columns 3. It also actuates the operation of compressor 13.

Main board 14 also actuates control panel 16 for manual operation.

Main board 14 actuates various contact boxes 115, 115' and 115" which are located besides column 3. Said control box 115, 115' and 115" via sensors 116, 116' and 116" indicate the position of column 3 and of platform 5. whether there are obstacles on wall 2, etc.

Air tanks 100, 100' and 100" actuate via control boxes 115, 115' and 115" the various pistons (not shown).

As the other parts above, also air compressor 13 is operated by main board 14.

What is claimed is:

1. A scaffold comprising:

a. a platform adapted to be erected adjacent and parallel to a wall;

b. columns carrying the platform and adapted for being connected to the wall, said columns being provided with electrically actuating means enabling the ascending and descending of the platform, and each said column comprising an outside sheet connected at both sides to a further sheet via a comb-like wall in such a manner that the sheets form a cavity between them, and the further sheet being provided with several openings;

c. a movable apparatus attached to the platform, which apparatus is able to move along the length of the platform and is provided with automatic means for performing a plastering operation and realizing obstacles;

d. automatic electrical pneumatic and/or electric hydraulic means for actuating movable parts of the scaffold; and e. a storage container suitably connected to the means performing the plastering operation.

2. A scaffold according to claim 1, in which the automatic electrical means are actuated by remote control means.

3. A scaffold according to claim 1, in which the platform comprises the following parts:

a. a floor;

b. two railings extending vertically along two sides of the floor;

c. at least one toothed bar extending along the side of the floor and being provided with means carrying the movable apparatus and causing the movement thereof;

d. supports for guiding electrical motors; and e. openings for the columns.

4. A scaffold according to claim 3, in which extend two toothed bars extending along both sides of the floor.

5. A scaffold according to claim 3, in which on the platform is located a compressor on which is mounted a board to which are connected a radio receiver and a control panel.

6. A scaffold according to claim 1, comprising one central column and at least one side column.

7. A scaffold according to claim 1 in which in the column is located at least one system which prevents the descent of the platform.

8. A scaffold according to claim 6, in which outside of the columns extend suitable cables connected to rotating drums on which they are rolled, the drums and the cables being actuated by motors.

9. A scaffold according to claim 6 in which the central column is connected to two drums each being actuated by a motor, both motors operating in a synchronized manner.

10. A scaffold according to claim 1, in which the movable apparatus is provided with an electrical eye, sensors and/or a camera.

11. A scaffold according to claim 1 including an electrically actuated pump for forwarding plastering material from the container to the plastering means.

12. A scaffold according to claim 1, in which the movable apparatus is attached below the platform.

* * * * *